United States Patent [19]

Yaffe

[11] 4,141,844

[45] Feb. 27, 1979

[54] SYNTHETIC AIRCRAFT TURBINE OIL

[75] Inventor: Roberta Yaffe, Glenham, N.Y.

[73] Assignee: Texaco Inc., New York, N.Y.

[21] Appl. No.: 810,714

[22] Filed: Jun. 28, 1977

[51] Int. Cl.[2] ..... C10M 1/48

[52] U.S. Cl. ..... 252/46.7; 252/47; 252/56 S

[58] Field of Search ..... 252/46.7, 47, 56 S

[56] References Cited

U.S. PATENT DOCUMENTS

| | | | |
|---|---|---|---|
| 2,218,283 | 10/1940 | Fuller | 252/47 |
| 2,963,432 | 12/1960 | Little et al. | 252/47 |
| 2,963,433 | 12/1960 | Little et al. | 252/47 X |
| 3,476,685 | 11/1969 | Oberender et al. | 252/46.7 |
| 3,850,824 | 11/1974 | Nebzydoski et al. | 252/46.7 |

*Primary Examiner*—Delbert E. Gantz
*Assistant Examiner*—Andrew Metz
*Attorney, Agent, or Firm*—Thomas H. Whaley; Carl G. Ries; James F. Young

[57] ABSTRACT

Synthetic lubricating oil composition having improved oxidation stability comprising a major portion of an aliphatic ester base oil having lubricating properties formed from the reaction of pentaerythritol and an organic monocarboxylic acid, and containing an alkylphenyl or alkarylphenyl naphthylamine, a dialkyldiphenylamine, a polyhydroxy anthraquinone, a hydrocarbyl phosphate ester and an S-alkyl-2-mercaptobenzimidazole.

10 Claims, No Drawings

SYNTHETIC AIRCRAFT TURBINE OIL

BACKGROUND OF THE INVENTION

Field of the Invention

This invention is concerned with a pentaerythritol ester base lubricating oil composition for a gas turbine engine. Gas turbine engines are operated under a wide range of temperature conditions. The lubricant must be fluid at extremely low temperatures and at the same time retain its lubricating properties in an engine which produces internal operating temperatures at 450°–550° F. or above. The lubricant is subjected to severe oxidation stresses under the high running temperatures encountered in such engines.

Ester base lubricating oil compositions prepared from pentaerythritol and a mixture of fatty acids containing selected additive combinations are well known. These lubricants are functional over a wide temperature range and exhibit good thermal and oxidative stability. The search for a still more effective, long lived ester base lubricant composition, however, is a major goal of lubricant manufacturers. In addition, more advanced gas turbine engines currently being developed and tested will put higher stresses on the lubricant composition and are projected to require improved lubricant compositions.

SUMMARY OF THE INVENTION

The synthetic lubricating oil composition of the invention comprises a major portion of an aliphatic ester base oil containing an alkylphenyl or alkarylphenyl naphthylamine, a dialkyldiphenylamine, a polyhydroxy anthraquinone, a hydrocarbyl phosphate ester and an S-alkyl-2-mercaptobenzimidazole. More specifically, the lubricating oil composition of the invention comprises a major portion of an aliphatic ester base oil formed from the reaction of pentaerythritol and an organic monocarboxylic acid having from about 2 to 18 carbon atoms per molecule containing:

(a) from about 0.3 to 5 percent by weight of the lubricating oil composition of alkyl or alkaryl derivatives of phenyl alpha-and beta-naphthylamines in which the alkyl radicals contain from 4 to 12 carbon atoms, and the alkaryl radical contains from 7 to 12 carbon atoms, (b) from about 0.3 to 5 percent by weight of a dialkyldiphenylamine in which the alkyl radicals contain from 4 to 12 carbon atoms, (c) from about 0.001 to 1 percent by weight of a polyhydroxyanthraquinone, (d) from about 0.25 to 10 percent by weight of a hydrocarbyl phosphate ester in which said hydrocarbyl radical contains an aryl ring and has from about 6 to 18 carbon atoms, and (e) from about 0.005 to 0.1 percent by weight of an S-alkyl-2-mercaptobenzimidazole wherein the alkyl group contains from 1 to 20, preferably 5–15 carbon atoms, linear or branched.

The lubricating oil composition of the invention provides substantial improvements in oxidative stability, particularly excellent control of acidity and viscosity increase under severe oxidizing conditions, over the prior art.

DETAILED DESCRIPTION

The base fluid component of the composition of the invention is an ester-base fluid prepared from pentaerythritol and a mixture of hydrocarbyl monocarboxylic acids. Polypentaerythritols, such as dipentaerythritol, tripentaerythritol and tetrapentaerythritol can also be employed in the reaction to prepare the base oil.

The hydrocarbon monocarboxylic acids which are used to form the ester-base fluid include the straight-chain and branched-chain aliphatic acids, as well as mixtures of these acids. The acids employed have from about 2 to 18 carbon atoms per molecule, and preferably from about 5 to 10 carbon atoms. Example of suitable acids are acetic, propionic, butyric, valeric, isovaleric, caproic, decanoic, dodecanoic, tertiary-butylacetic and 2-ethylhexanoic acid, including mixtures.

In general, the acids are reacted in proportions leading to a completely esterified pentaerythritol or polypentaerythritol with the preferred ester bases being the pentaerythritol tetraesters. Examples of such commercially available tetraesters include pentaerythritol tetracaproate, which is prepared from purified pentaerythritol and crude caproic acid containing other $C_{5-10}$ monobasic acids. Another suitable tetraester is prepared from a technical grade pentaerythritol and a mixture of acids comprising 38 percent valeric, 13 percent 2-methyl pentanoic, 32 percent octanoic and 17 percent pelargonic acids, by weight.

The ester base fluid comprise the major portion of the fully formulated synthetic ester base lubricating oil composition. In general, this ester base fluid is present in concentrations from about 90 to 98 percent of the composition, by weight.

The essential alkyl or alkaryl phenyl naphthylamine component of the invention is represented by the formula:

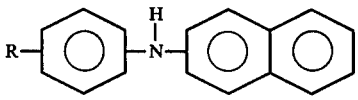

in which R is an alkyl radical containing from about 4 to 12 carbon atoms or an alkaryl radical containing from 7 to 12 carbon atoms. This radical can be a straight or branched chain alkyl radical with th tertiary alkyl structure being preferred or it can be an alkylaryl radical.

Specific effective compounds of this class include N-(para-tertiary-octylphenyl)-alpha naphthylamine, N-(4-cumylphenyl)-alpha- or beta-naphthylamine, N-(paratertiary-octyl-phenyl)-beta-naphthylamine and the corresponding para-tertiary-dodecylphenyl and para-tertiary-butylphenyl alpha- or beta-naphthylamines. The preferred concentration of this component is from about 0.5 to 2.5 percent by weight.

Anoter essential component of the lubricating oil composition of the invention is a dialkyldiphenylamine. These compounds are represented by the formula:

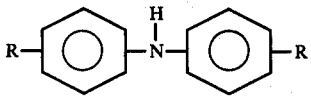

in which R is an alkyl radical having from about 4 to 12 carbon atoms. Suitable alkylamines include diotyldiphenylamine, didecyldiphenylamine, didodecyldiphenylamine, dihexyldiphenylamine and similar compounds. Dioctyldiphenylamine is the preferred compound and the preferred conconcentration is from 0.5 to 2.0 percent, by weight.

The essential metal deactivator of the lubricating oil composition of the invention is a polyhydroxyanthraquinone. Suitable compounds in this class are the dihydroxyanthraquinones such as 1,4-dihydroxyanthraquine and 1,5-dihydroxyanthraquinone and the higher polyhydroxyanthraquinones such as 1,2,5,8 tetrahydroxyanthraquinone. The preferred concentration of this component is from about 0.1 to 0.5 weight percent.

Another component of the lubricating oil composition of the invention is a hydrocarbyl phosphate ester, more specifically a trihydrocarbyl phosphate in which the hydrocarbyl radical is an aryl or alkaryl radical or mixture thereof containing from 6 to 18 carbon atoms and preferably from 6 to 12 carbon atoms. Effective specific compounds include tricresylphosphate, cresyl diphenylphosphate and triphenylphosphate. These compounds are preferably present in the lubricating oil composition in a concentration ranging from about 0.5 to 5 wt. %.

Another essential component of the lubricating oil composition is an S-alkyl-2-mercaptobenzimidazole compound wherein the alkyl group contains from 1 to about 20 carbon atoms, linear or branched, preferably from about 5 to 15 carbon atoms. This component is present in the lubricating oil composition in an amount of from about 0.005 to about 0.1%, preferably in a concentration range of from about 0.025 to about 0.075%, by weight.

The S-alkyl-2-mercaptobenzimidazole components of the present invention can be prepared in good gields and suitable purity by reacting a commercially available 2-mercaptobenzimidazole with an alkali metal hydroxide in a polar medium such as a lower alcohol followed by treatment with a suitable alkyl halide or bromide. After filtration and vacuum stripping the solvent, the desired alkylated compound is obtained.

The following example illustrates the preparation of S-n-hexyl-2-mercaptobenzamidazole.

2-mercaptobenzimidazole in an amount of 15 grams was reacted with 5.6 grams of potassium hydroxide in 400 ml of refluxing isopropanol for 30 minutes. Thereafter there was added to the reaction mixture 16.5 grams of 1-bromo-hexane and refluxing continued for 2 hours. Thereafter the reaction mixture was cooled, the solids (potassium bromide) removed by filtration and the isopropanol stripped in vacuo. The crude reaction product residue was redissolved in pentane, water washed, dried over magnesium sulfate and restripped in vacuo.

The ester base oil employed in preparing the lubricating oil composition of the invention comprises pentaerythritol containing a minor amount of dipentaerythritol esterified with a mixture of fatty acids. The base oil consisted of technical grade pentaerythritol ester made from a mixture of carboxylic acid consisting of (mole %):

| | |
|---|---|
| i-$C_5$ | 8 ± 3% |
| n-$C_5$ | 23 ± 5% |

-continued

| | |
|---|---|
| n-$C_6$ | 20 ± 5% |
| n-$C_7$ | 27 ± 5% |
| n-$C_8$ | 7 ± 5% |
| n-$C_9$ | 16 ± 3% |

This ester base oil had the following properties:

| | |
|---|---|
| Viscosity, cs at 210° F. | (5.01) |
| Viscosity, cs at 100° F. | (25.6) |
| Viscosity, cs at −40° F. | (7005) |
| Viscosity Index | (140) |
| Flash, ° F. | (515) |

The above base oil was blended with all ofthe prescribed essential additives with the exception of the S-alkyl-2-mercaptobenzimidazole to form a Base Fluid. Based on a fully formulated lubricant composition, the Base Fluid consisted of about 95.4 weight percent of the ester base oil decribed above with 1.5 weight percent of t-octyl-phenyl-α-naphthylamine, 1.0 weight percent of dioctyl-diphenylamine, 2.0 weight percent of tricresylphosphate and 0.1 weight percent of quinizarin.

The oxidation stability of the lubricant of the invention as compared to the base blend was determined in the Rolls Royce (RR 1001) Oxidation Test (D. Eng. 2497 Supplement Method No. 12). The results are set forth in the following Table.

TABLE

| | ROLLS ROYCE 1001 OXIDATION 260°C./6 HRS. | | |
|---|---|---|---|
| | BASE FLUID | BASE FLUID + 0.1% Additive "A" BY WEIGHT | BASE FLUID + 0.05% Additive "A" BY WEIGHT |
| % Viscosity Change (100° F.) | 74.5 | 37.6 | 13.4 |
| Total Acid Number Change | 4.77 | 2.94 | 0.67 |

Additive "A" - S-(n-hexyl)-2-mercaptobenzimidazole.

The data in the above Table show that the oxidative stability of the lubricating oil compositions of the present invention are significantly improved in comparison to the Base Fluid.

In comparison to the Base Fluid, the composition showed a reduction in Viscosity Increase of about 49.8 percent at 0.1% concentration and about 82 percent at 0.05% concentration, by weight.

Similar good results were found with respect to the reduction in Total Acid Number Increase over the Base Fluid, 38.4% at 0.1% concentration and 86% at 0.05% concentration, by weight.

The lubricant composition of this invention containing the additive at 0.05 weight percent was found to fully satisfy the requirements of the Navy MIL-L-23699B Specification Oxidation-Corrosion Test (400° F./72 HRS.) and the requirements of the Pratt and Whitney Aircraft Specification PWA 521-B Oxidation-Corrosion (425° F./48 HRS.) and SOD Lead Corrosion (375° F./5 HRS.) Tests.

Obviously, many modifications and variations of the invention as hereinbefore set forth may be made without departing from the spirit and scope thereof and therefore only such limitations should be imposed as are indicated in the appended claims.

I claim:

1. A synthetic lubricating oil composition for a gas turbine engine consisting of a major portion of an aliphatic ester base oil having lubricating properties formed from the reaction of pentaerythritol and an organic monocarboxylic acid having from about 2 to 18 carbon atoms per molecule and:

from about 0.3 to 5 percent by weight of the lubricating oil composition of an alkyl or alkaryl phenyl naphthylamine in which the alkyl radical has from 4 to 12 carbon atoms and the alkaryl radical has from 7 to 12 carbon atoms, from about 0.3 to 5 percent by weight of a dialkyldiphenylamine in which the alkyl radicals have from 4 to 12 carbon atoms, from about 0.001 to 1 percent by weight of a polyhydroxy-substituted anthraquinone, from about 0.25 to 10 percent by weight of a hydrocarbyl phosphate in which said hydrocarbyl radical contains an aryl ring and contains from about 6 to 18 carbon atoms, and from about 0.005 to 0.1 percent by weight of an S-alkyl-2-mercaptobenzimidazole containing from 1 to about 20 carbon atoms in the alkyl portion, linear or branched.

2. A lubricating oil composition as claimed in claim 1 containing about 0.05% of said S-alkyl-2-mercaptobenzimidazole.

3. A lubricating oil composition as claimed in claim 1 containing from about 0.025 to 0.075 percent of S-hexyl-2-mercaptobenzimidazole, by weight.

4. A lubricating oil composition as claimed in claim 1 wherein the naphthylamine is octylphenyl-alpha of beta-naphthylamine.

5. A lubricating oil composition as claimed in claim 1 containing from about 0.5 to 2.0 percent of a dialkyldiphenylamine, by weight.

6. A lubricating oil composition as claimed in claim 5, wherein the dialkyldiphenylamine is a dioctyldiphenylamine.

7. A lubricating oil composition as claimed in claim 1 containing from about 0.01 to 0.5 percent of said polyhydroxy-substituted anthraquinone, by weight.

8. A lubricating oil composition as claimed in claim 7 wherein the polyhydroxy-substituted anthraquinone is 1,4-dihydroxyanthraquinone.

9. A lubricating oil composition as claimed in claim 1 containing from about 0.5 to 5 percent of a hydrocarbyl phosphate ester, by weight.

10. A lubricating oil composition as claimed in claim 1 wherein the aliphatic ester base oil is present in a concentration of from about 90 to 98 percent of the composition, by weight.

* * * * *